US006887093B1

(12) United States Patent
Stenberg et al.

(10) Patent No.: US 6,887,093 B1
(45) Date of Patent: May 3, 2005

(54) PATCH PANEL LATCHING AND HOLDING MECHANISM APPARATUS AND METHOD

(75) Inventors: James T. Stenberg, Portland, ME (US); Michael C. Davison, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/716,628

(22) Filed: Nov. 20, 2003

(51) Int. Cl.[7] ..... H04R 13/62
(52) U.S. Cl. ..... 439/372; 439/512; 439/953
(58) Field of Search ..... 439/372, 373, 439/507, 511, 512, 350, 357, 358, 953

(56) References Cited

U.S. PATENT DOCUMENTS 4,556,270 A * 12/1985 Schutzle et al. ..... 439/359
4,787,858 A * 11/1988 Killian, Jr. ..... 439/350
5,174,781 A * 12/1992 Muzslay ..... 439/372
5,857,869 A * 1/1999 Parcel et al. ..... 439/372
5,860,827 A * 1/1999 Lee ..... 439/373
6,045,385 A * 4/2000 Kane ..... 439/327

* cited by examiner

*Primary Examiner*—Hien Vu
(74) *Attorney, Agent, or Firm*—Baker & Hostetler LLP

(57) ABSTRACT

High-power coaxial signal lines, as used for example in television transmitters, employ patch panels with coaxial connections typically 7 cm to 30 cm in diameter to permit rerouting of signals. Like smaller patch panels, these use U-shaped coaxial links; rigid U-links for this application may be a meter between centers and weigh many kilograms. A patch panel handle and latch mechanism includes a gripping handle element integral with a latching element, the combination of which permits the user to grasp a pair of handles, release the latches retaining a U-link, remove the U-link from its position on the patch panel, and reposition the U-link without altering grip. Unlike previous designs, the novel handle/latch mechanism avoids hammers and clamps, as well as avoiding grasping large, fragile, possibly hot or dirty equipment, allowing the task to be performed with integral handles.

22 Claims, 4 Drawing Sheets

PATCH PANEL LATCHING AND HOLDING MECHANISM APPARATUS AND METHOD

FIELD OF THE INVENTION

The present invention relates generally to patch panels. More particularly, the present invention relates to manually operated coaxial line patch panels for radio frequency signal switching.

BACKGROUND OF THE INVENTION

Patch panels are used in many industries for distribution and redirection of electrical signals. In the broadcast industry, coaxial lines in the range from a few centimeters to several decimeters in diameter carry radio frequency signals from amplifiers and transmitters to broadcast antennas atop towers that may stand up to half a kilometer or taller, as well as to non-broadcast loads. Such transmitters and coaxial lines may be highly reliable, but failure modes exist, and, as with virtually all electronic equipment, provisions may preferably be made for fault analysis requiring disassembly.

Typical patch panels for the broadcast industry usually consist of coaxial ports connected to typically large, rigid, coaxial jumpers, the ends of which are fastened to their respective ports with nuts and bolts to form flanged assemblies, with collapsible finger structures on the ports deflected inward by clamps onto raised ridges on the jumpers, with which ridges grooves in the finger structures interlock, or with other attachment devices achieving robust, low-loss joints. The jumpers are typically referred to in the industry as U-links.

The insertion and removal of fittings so restrained is time consuming, requires in many cases considerable physical effort, and can result in significant stress to the U-link and other patch panel components.

Accordingly, it is desirable to provide a patch panel apparatus and method that allows a single user to readily and reliably redirect high power radio frequency signals without exerting significant physical effort and without applying significant stress to the patch panel.

SUMMARY OF THE INVENTION

The foregoing needs are met, to a great extent, by the present invention, wherein in one aspect an apparatus and method are provided that in some embodiments allows a single user readily to grasp, unlock, disengage, move, reengage, and positively lock the elements of a patch panel and U-link assembly for rigid coaxial cable in diameters from a few centimeters to a few decimeters.

In accordance with one embodiment of the present invention, a handle and latch mechanism for a patch panel and U-link system is provided, comprising a plunging and rotating rod attached to the U-link element of the patch panel and U-link system, a latch finger at a first end of said rod, a handle at a second end of said rod, a guide mechanism to constrain the motion of said rod to a path parallel to the axis of a first end section of the U-link orthogonal to the patch panel, and a catch fitting attached to the patch panel into which said latch finger inserts.

In accordance with another embodiment of the present invention, a handle and latch mechanism for a mated patch panel and U-link system is provided, comprising means for urging the U-link into contact with the patch panel, means for latching the U-link to the patch panel, means for releasing the U-link from contact with the patch panel, and means for gripping the U-link without changing hand placement from that required for latching and releasing the U-link.

In accordance with yet another embodiment of the present invention, a method for attaching, holding, and releasing a signal path linking component from a radio frequency signal path comprises urging the linking component into a position where it can complete a portion of a signal path, latching the linking component for indefinite situation at the location where urged, reversibly releasing the linking component from the latched condition, and grasping the linking component for disassembly and transport.

There have thus been outlined, rather broadly, certain embodiments of the invention, in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
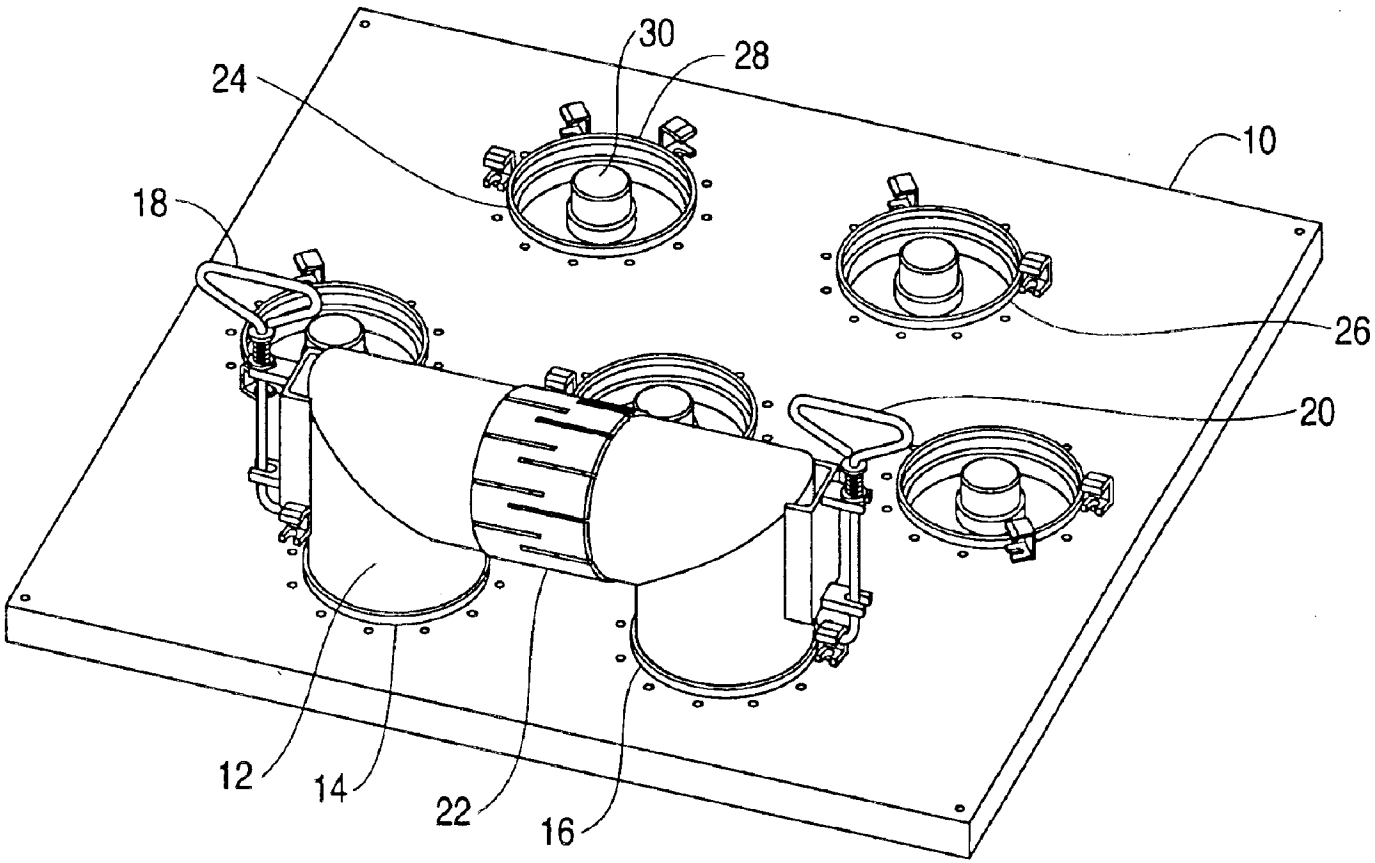
FIG. 1 is an illustration of a perspective view of an exemplary patch panel, U-link, and latch mechanism according to this invention.

The invention will now be described with reference to the drawing figures, in which like reference numerals refer to like parts throughout.

FIG. 1 is an illustration of an embodiment of the present inventive apparatus and method. A patch panel 10 has a first U-link 12 inserted into a first port 14 and a second port 16 and retained by a first latch/handle 18 and a second latch/handle 20. The first U-link 12 has an integral fitting 22 that permits the U-link to change length sufficiently to accommodate at least small spacing variations between pairs of ports 14 and 16, 24 and 26, etc., as well as providing one of several possible mechanisms for assembling a U-shaped coaxial link. Each port, such as 24, has an outer coaxial contact 28 and an inner coaxial contact 30. The first U-link 12 has outer and inner contacts that mate with those of the ports, and insulating features that keep the spacing between the outer and inner conductors of the first U-link 12, and thus the electrical impedance at each joint, as uniform as practicable.

Figure 2:
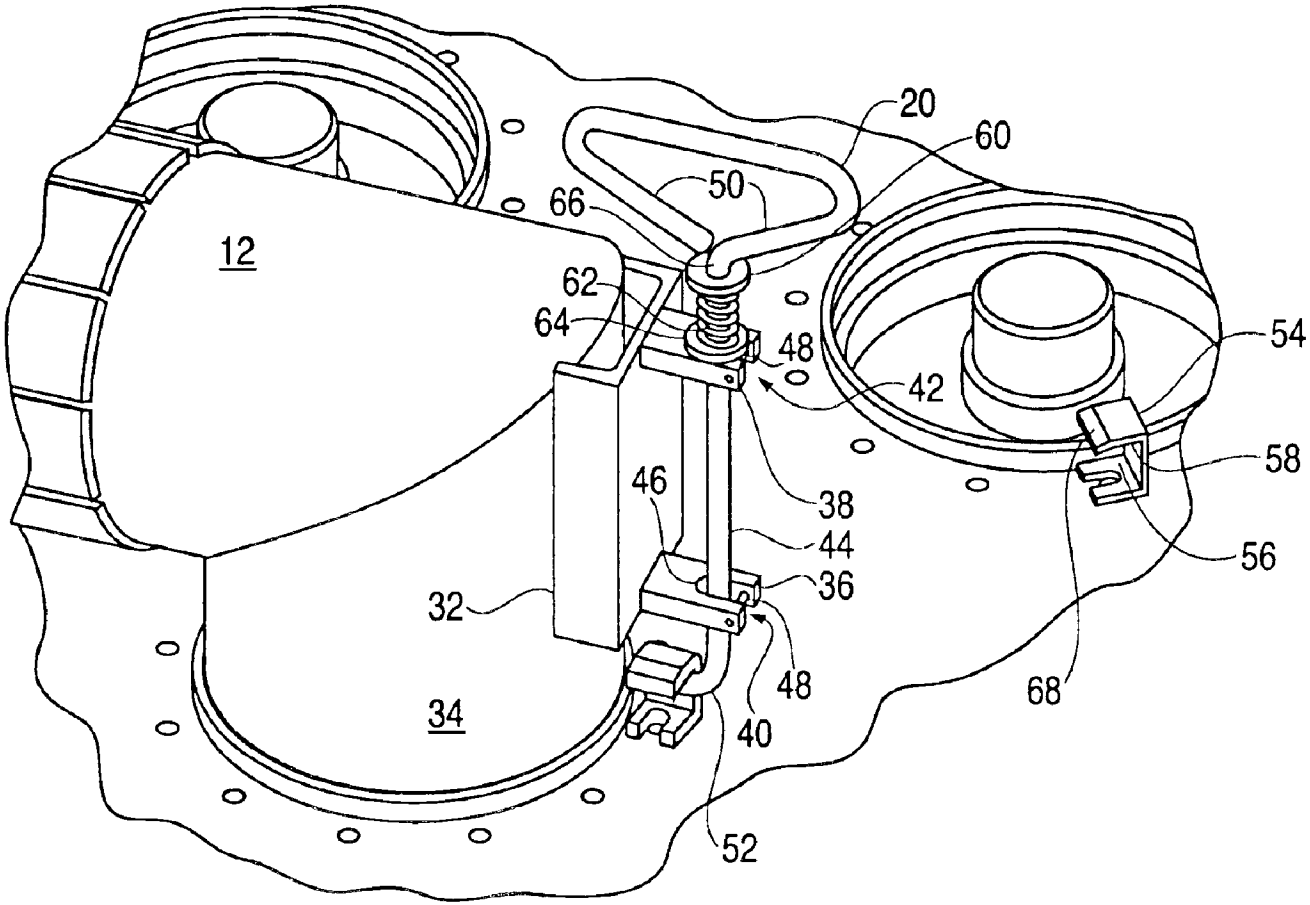
FIG. 2 is an illustration of a closeup view of an exemplary latch mechanism of FIG. 1.

FIG. 2 is an expanded illustration of the patch panel of FIG. 1, showing the parts of a latch apparatus in greater detail. A support 32 is attached to a second end 34 of the first U-link 12. The support 32 may be affixed to the first U-link 12 by welding, riveting, and other durable securing methods suitable to assemblies of the materials used. For example, since the first U-link 12 outer conductor material is commonly aluminum, and the support 32 may likewise be aluminum, welding may be practical. A support 32 made from fiberglass, another possible material, can be held in place by rivets, by epoxy or similar adhesives, or by a perimeter clamp band.

A proximal guide 36 and a distal guide 38 are attached to the support 32; captured in a proximal guide hole 40 and a distal guide hole 42 is a rod portion 44 of the second latch/handle 20. The guide holes 40 and 42 shown have arcuate gaps 46 closed with pins 48 instead of having, for example, complete, circular guide holes. This guide hole assembly eases installation and replacement of the latch/handle 20 by removal of the pins 48. The rod 44 is formed into a handle 50 at the end distal to the patch panel 10. The handle 50 can be formed of a material and size that can make it sufficiently sturdy that the U-link can be lifted, carried, twisted, worked to compensate for binding misalignment, and otherwise exercised without appreciable permanent deformation to the handle 50.

The rod end proximal to the patch panel 10 in the preferred embodiment is shown to be bent into a latch finger 52 at roughly a right angle to the central section of the rod 44, which latch finger 52 is thus roughly parallel to the surface of the patch panel 10. A catch fitting 54 is sized and located to accept the latch finger 52. The catch fitting 54 can have a bearing surface 56 against which the latch finger 52 rests that has a retention pocket 58 to urge the latch finger 52 to remain engaged. The retention pocket 58 can take the form of a bent-down tip, a groove set back from the tip, or another configuration that tends to retain the latch finger 52.

To further urge the latch finger 52 to remain engaged, the portion of the rod 44 near the distal guide 38 can have a stop 60 fastened to the rod 44, a helical compression spring 62 pressing outward against the stop 60 and the outer guide 38, and inward against a thrust washer 64, which parts can apply continuous pressure urging the rod 44 away from the patch panel 10 surface. It has been demonstrated that a sufficiently tight radius of bend 66 in the rod 44 where forming the handle 50 can cause a stop 60 with a close-fitting center hole to bind at the bend 66, permitting the stop to function without recourse to drilling and pinning, grooving for a snap ring, welding, upset of the rod material into ears, or other retention treatments that can weaken the formed metal of the rod 44. In order for the use of the handle bend as a part of the retention treatment to remain a net benefit, the radius of curvature of the bend 66 cannot be so tight as to weaken the rod 44 enough to degrade its mechanical strength below system needs. Alternative retention treatments can be used as long as the final strength of the mechanism meets system requirements.

Figure 3:
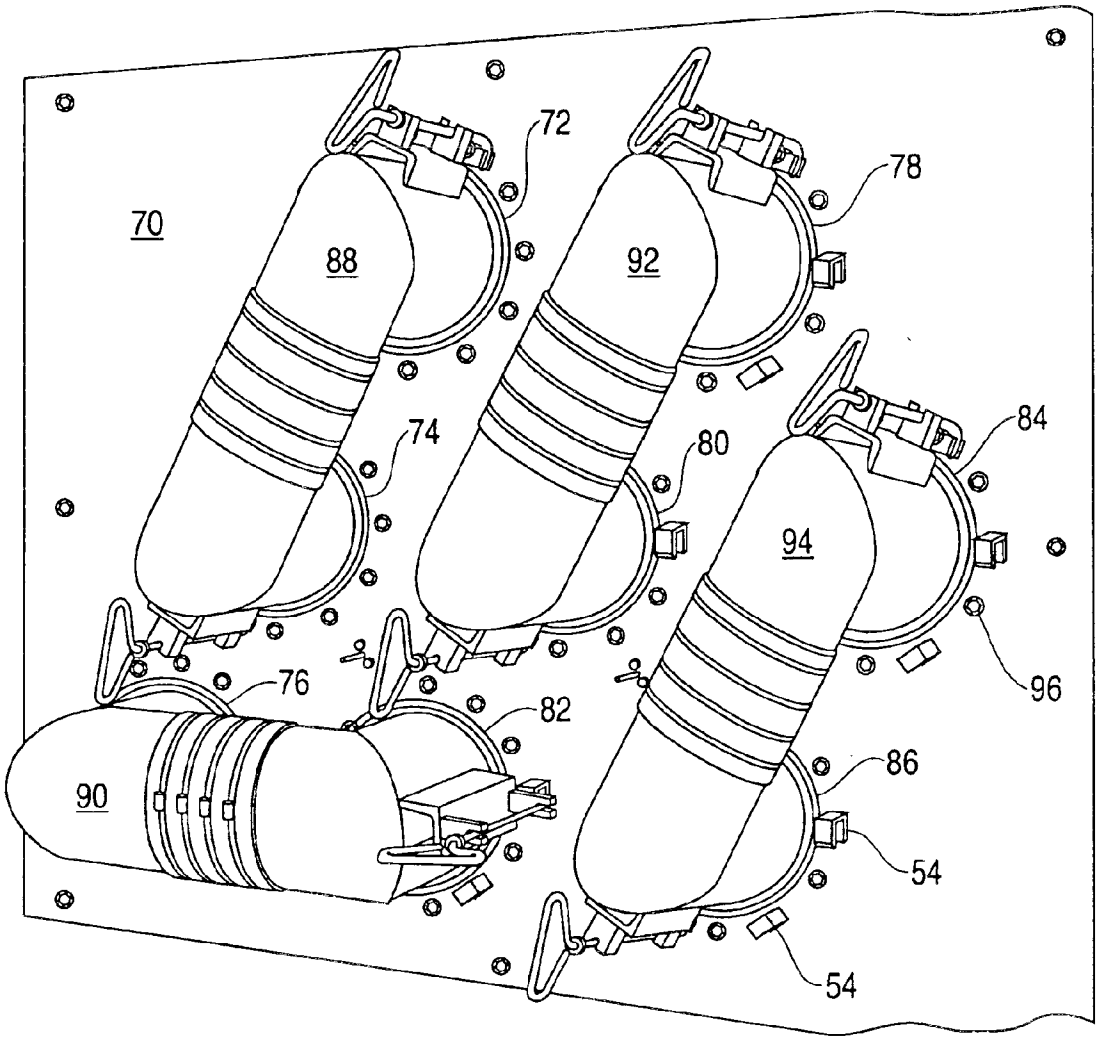
FIG. 3 is an illustration of an exemplary eight-port patch panel fully populated with U-links.

FIG. 3 is an illustration of a fully populated exemplary patch panel 70 with eight ports 72–86 and with four U-links 88–94 installed. The signal lines feeding the ports determine the desired connections; for a highly useful patch panel, two inputs from two transmitters, two outputs to a combiner, two return lines from the combiner, an antenna transmission line, and a connection to a high-power resistive load, known in the art as a station load, may be connected, and the layout may permit a variety of connections, such as connecting a transmitter to each of the combiner inputs, the antenna to one combiner output, and the resistive load to the other combiner output.

A patch panel 70 configured to support all of these configurations may need to have each of the U-links 88–94 oriented to connect a first port to any of a large number of other ports, typically limited to those uniformly surrounding the first port, and oriented at angles thereto that are multiples of 60 degrees from a reference angle. In order to use the U-links, each of the orientations can have a catch fitting 54 at any of the useful angles. The shown ports 72–86 have mounting bolts 96 every 30 degrees, allowing the holes admitting the mounting bolts 96 to be used to secure the catch fittings 54. For ports with numbers of mounting bolts 96 different from those shown, and thus at different incremental angles than the 30 degrees of a 12-bolt pattern, catch fittings 54 with longer upper surfaces can be positioned to capture latch fingers 52 at locations away from the mounting holes. As shown in FIG. 2, a catch fitting 54 can include a bevel 68 on its upper surface to deflect rather than stop a slightly misaligned latch finger 52 during assembly, easing the assembly operation.

Coaxial signal ports 72–86, fed to the panel 70, for example, from the back of the panel, can be positioned so that equal-length, front-mounted, rigid U-links 88–94 can connect any first port to any second port that requires such a connection. An example of a useable set of connections is port 74, which, possibly using pairs of permanent elbows on the back of the panel to complete some circuits, can connect to any of the ports 72, 80, 82, or 76. Retention of the U-links to connect pairs of desired ports may be accomplished using spring-loaded assemblies of handles, fasteners, guides, and receptacles. The spring-loaded retention assemblies further permit rapid release of the retention fittings and permit the user to grasp, remove, carry, reinstall, and lock in place a U-link while retaining a grasp on the assemblies.

Figure 4:
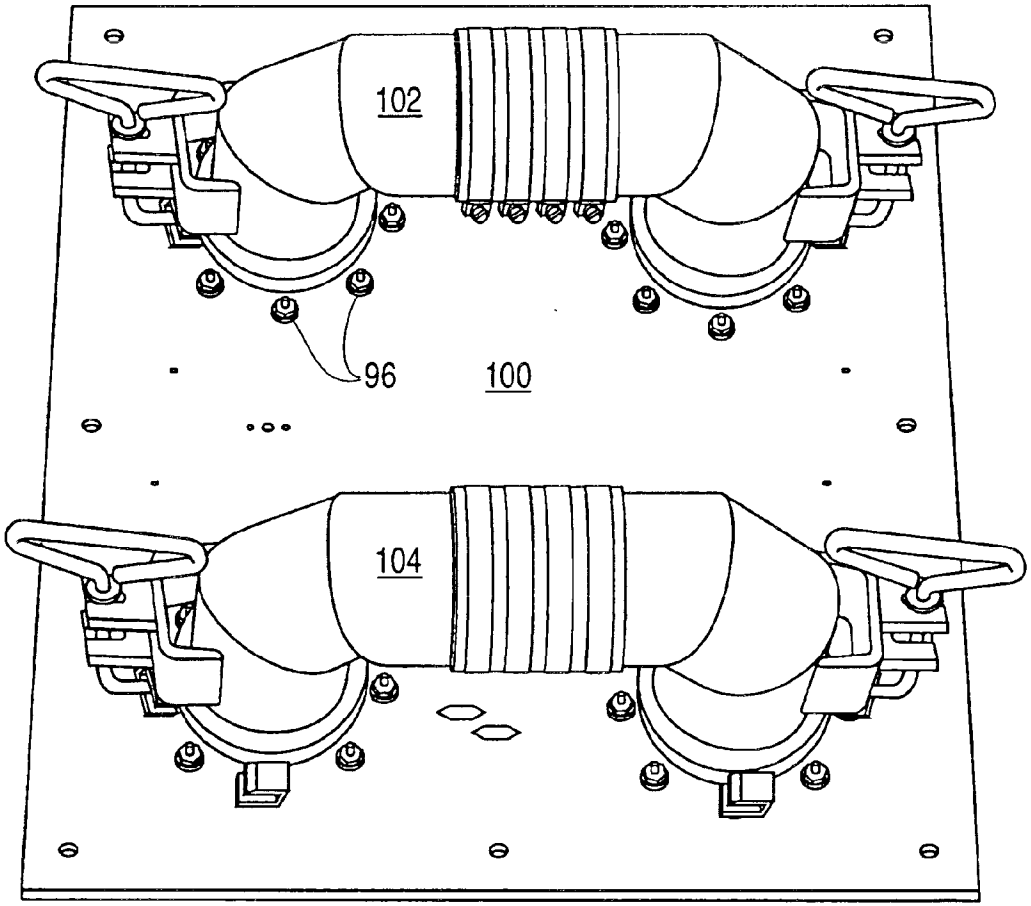
FIG. 4 is an illustration of an exemplary four-port panel.

FIG. 4 is an illustration of an exemplary four-port patch panel 100, which can be used to allow two signals to pass to either of two loads, such as to connect the normal output of a combiner to an antenna using a first U-link 102, and the off-frequency output of that combiner to the station load using a second U-link 104, or to send the normal output to the station load, such as for testing, while the off-frequency output is connected to the antenna, by repositioning the U-links 102 and 104 orthogonally to the positions shown. It may be observed that the U-links 102 and 104 in FIG. 4 are constructed using a multiplicity of 45-degree bends rather than the two 90-degree bends shown in the U-links 88-94 in FIG. 3. Such variations are minor considerations regarding latch/handle 18 design. It may further be observed that the mounting bolt pattern in FIG. 4 places bolts 96 at 45-degree increments, which is suitable for the design shown.

Although an example of the exemplary latch mechanism is shown in use on a patch panel, as illustrated in FIGS. 1–4, it will be appreciated that the exemplary latch mechanism can be used with other items. Also, although the exemplary latch mechanism is useful to support, retain, and provide a handle for carrying patch panel U-links for high-power coaxial lines in radio frequency broadcast applications, it can also be used to support, retain, and carry other awkward items, such as, for example, waveguide elements, hot-pluggable electronic devices, food service wares, and other electronic and non-electronic apparatus generally stable while in place but standing to benefit from simple retention hardware designs that add convenience to lifting and orienting tasks.

Several details of the preferred embodiment are according to design preference. For example, the latch/handles 18 and 20 shown in FIGS. 1–4 are formed from single pieces of rod material. Simple handles with a single bend to afford an L shape may be suitable for some applications, particularly for small, low-mass systems. More constructed handles are also feasible, for example with a welded-on T made from the same rod material in place of the bent D shape 50 shown in FIG. 2. Likewise, other materials and forms for the handle end may be practical in other applications. A cushioned grip may be added. At the catch fitting 56 end shown in FIG. 2, the L bend 52 of the preferred embodiment may be replaced by fabricated, forged, or welded protrusive fittings that may permit a plurality of catch shapes to be used. The guides 36 and 48 used can be made in two fabricated parts instead of a groove 46 barred with a pin 48; this may be preferred if it can provide tighter positioning precision, improved appearance, greater strength, lower cost, or other benefit. The catch fitting 56 similarly may be fabricated from a solid block from which only the interference materials are removed in order to maximize strength within a particular size of catch fitting 56, or may be extruded or bent to shape. The tensioning spring stop 60 can be attached to the rod 44 using a variety of methods and materials, such as grooves or holes in the rod, braising or welding of the stop 60 to the rod 44, or affixing of a drilled block on the rod 44, which block extends to the distal bend 66 to avoid weakening the rod.

The mechanism can be formed as a stationary handle extending as a rod insertable into a capture mechanism, where a plunger within or alongside the rod forces at least one locking ball or pin outward to secure the rod in the capture mechanism, and a trigger or button on the handle may be pulled or pushed against a spring to release the ball or pin and allow the U-link to be pulled free of the patch panel.

The mechanism of the rod can be fabricated from a slotted tube or from a block of material, with the guides formed as pins riding within and largely surrounded by the material of the rod.

The material of the entire latch mechanism can be any metallic or nonmetallic material or combination of materials of sufficient strength and stiffness to be used as a support handle as well as a locking mechanism. Tradeoffs between manufacturability, durability, cost of materials, dissimilar metals promoting corrosion, and other issues may be considered.

It should be appreciated that embodiments of this invention, among other capabilities, allow a single user to pick up and install a U-link of comparatively large size without needing to change grip or use tools. These embodiments afford further isolation of the user from dust, grease, or high temperatures that may make grasping the body of the U-link undesirable, and tends to prevent misadventures such as squeezing or dropping the U-link, which may dent or otherwise distort its thin wall material, thereby introducing reflective transmission losses.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to that fall within the scope of the invention.

What is claimed is:

1. A handle and latch mechanism for a patch panel and U-link system having a contact, comprising:

a plunging and rotating rod attached to a U-link element of the U-link system;

a latch finger at a first end of said rod;

a handle for grasping the U-link element at a second end of said rod;

a guide mechanism attached to the U-link system to constrain a motion of said rod to a path parallel to an axis of a first end section of the U-link element substantially orthogonal to the patch panel;

a catch fitting attached to the patch panel into which said latch finger inserts;

a stop affixed to said rod; and a spring bearing against said stop at a first end of said spring.

2. The handle and latch mechanism of claim 1, further comprising a second end of said spring, bearing against a face of said guide mechanism to urge said rod to plunge away from the patch panel.

3. The handle and latch mechanism of claim 1, further comprising a support affixed to the U-link system in such orientation as to permit attachment of said guide mechanism thereon.

4. The handle and latch mechanism of claim 1, further comprising an aperture in said guide mechanism affording constraint to a motional axis of said rod.

5. The handle and latch mechanism of claim 1, further comprising a bearing face on said guide mechanism against which said spring rests.

6. The handle and latch mechanism of claim 5, further comprising a thrust washer interposed between said spring and said bearing face on said guide mechanism.

7. The handle and latch mechanism of claim 1, wherein said guide mechanism further comprises a first fitting and a second fitting.

8. The handle and latch mechanism of claim 7, wherein said first fitting of said guide mechanism has a first arcuate slot admitting said rod and said second fitting of said guide mechanism has a second arcuate slot admitting said rod.

9. The handle and latch mechanism of claim 8, wherein said first and second arcuate slots admitting said rod into said first fitting and said second fitting are formed into closed passages for confinement of said rod.

10. The handle and latch mechanism of claim 8, wherein said first and second arcuate slots admitting said rod into said first fitting and said second fitting are formed into closed passages for confinement of said rod by pins bridging open ends of the slots thereof.

11. The handle and latch mechanism of claim 8, wherein said first and second arcuate slots admitting said rod into said first fitting and said second fitting are formed into closed passages for confinement of said rod by screws bridging the open ends of the slots thereof.

12. The handle and latch mechanism of claim 7, further comprising a first hole passing through said first fitting concentric with the motional axis of said rod and a second hole passing through said second fitting concentric with the motional axis of said rod.

13. The handle and latch mechanism of claim 1, wherein said guide mechanism further comprises a single integral unit attached to the U-link system, said guide mechanism guiding said rod and providing a bearing surface for said second end of said spring.

14. The handle and latch mechanism of claim 1, wherein said spring is a helical coil spring positioned with an axis of a helix thereof substantially coaxial with said rod.

15. The handle and latch mechanism of claim 1, wherein said handle is formed from said rod by bending said second end of said rod into a handle of size proportional to human hands and further proportional to a weight of said U-link system to be carried therewith.

16. The handle and latch mechanism of claim 1, wherein said handle is formed from said rod by bending said second end of said rod with a single, substantially right-angle bend leaving a section of rod beyond the bend as a handle proportional to human hands and further proportional to a weight of the U-link system to be carried therewith.

17. The handle and latch mechanism of claim 1, wherein said catch fitting attaches to the patch panel with a bolt.

18. The handle and latch mechanism of claim 1, wherein said catch fitting restrains the latch finger from rotation with a detent.

19. The handle and latch mechanism of claim 1, wherein said catch fitting has a bevel on a surface distal to the patch panel.

20. A handle and latch mechanism for a mated patch panel and U-link system having a contact, comprising:

means for urging a U-link system into contact with a patch panel;

means for latching the U-link system to the patch panel;

means for releasing the U-link system from contact with the patch panel;

means for gripping the U-link system without changing hand placement from that required for latching and releasing the U-link system;

means for stopping the means for latching when engaged with the patch panel; and means for springing against said stopping means.

21. The handle and latch mechanism of claim 20, further comprising means for accommodating a plurality of angular orientations for the U-link system to mate on the patch panel having a plurality of U-link system-accepting ports.

22. A method for attaching and releasing a signal-path-linking component having a contact from a radio frequency signal path, comprising:

providing a signal path for a radio frequency signal having a panel with interruptions;

grasping handles on a linking component and urging the linking component into ends of the interruptions to complete the signal path;

attaching the linking component for situation at a location where urged by a single motion of rotating and axially plunging the handles on the linking component to engage a catch fitting on the panel; and reversibly releasing a linking component from the latched condition by a single motion of rotating and axially withdrawing the handles on the linking component to disengage from the catch fitting.

* * * * *

UNITED STATES PATENT AND TRADEMARK OFFICE

CERTIFICATE OF CORRECTION

PATENT NO. : 6,887,093 B1
DATED : May 3, 2005
INVENTOR(S) : James T. Stenberg et al.

It is certified that error appears in the above-identified patent and that said Letters Patent is hereby corrected as shown below:

Column 8,
Line 13, please replace “the” with -- a --.

Signed and Sealed this

Twelfth Day of July, 2005

JON W. DUDAS
*Director of the United States Patent and Trademark Office*